United States Patent [19]

Bartkowiak et al.

[11] Patent Number: 4,994,089

[45] Date of Patent: Feb. 19, 1991

[54] CARRIER MIXTURE FOR THE DYEING OF POLYESTER MATERIALS: N-ALKYLPHTHALIMIDE AND AROMATIC ESTER OR ETHER

[75] Inventors: Frank Bartkowiak; Hans Schulze, both of Cologne; Wolf-Dieter Schröer, Munich; Günther Boehmke, Leverkusen; Karlhans Jakobs, Bergisch Gladbach; Willi Schössler, Cologne, all of Fed. Rep. of Germany

[73] Assignee: Bayer Aktiengesellschaft, Leverkusen, Fed. Rep. of Germany

[21] Appl. No.: 414,051

[22] Filed: Sep. 28, 1989

[30] Foreign Application Priority Data

Oct. 12, 1988 [DE] Fed. Rep. of Germany ..... 3834737

[51] Int. Cl.[5] ..... C09B 67/38; D06P 1/64; D06P 3/54

[52] U.S. Cl. ..... 8/574; 8/532; 8/533; 8/583; 8/586; 8/610; 8/922

[58] Field of Search ..... 8/574, 583, 586, 610

[56] References Cited

U.S. PATENT DOCUMENTS 3,574,513 4/1971 Wolf et al. ..... 8/519
4,032,291 6/1977 Delliaw ..... 8/580

FOREIGN PATENT DOCUMENTS 33715 8/1981 European Pat. Off. .

*Primary Examiner*—A. Lionel Clingman
*Attorney, Agent, or Firm*—Sprung Horn Kramer & Woods

[57] ABSTRACT

The carrier mixture contains N-alkylphthalimides and compounds of the general formula

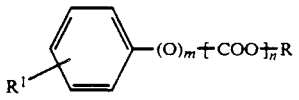

in which

R is $C_1$–$C_7$-alkyl; phenyl, benzyl or phenylethyl, which can be substituted by $C_1$–$C_4$-alkyl, $C_1$–$C_4$-alkoxy or $C_1$–$C_4$-alkoxycarbonyl, $R^1$ is hydrogen, $C_1$–$C_4$-alkyl, $C_1$–$C_3$-alkylcarbonyloxy, hydroxyl or $C_1$–$C_4$-alkoxycarbonyl, m is 0 or 1, n is 0 or 1, m and n not being 0 at the same time.

4 Claims, No Drawings

CARRIER MIXTURE FOR THE DYEING OF POLYESTER MATERIALS; N-ALKYLPHTHALIMIDE AND AROMATIC ESTER OR ETHER

The invention relates to carriers, their preparations and processes for the dyeing of polyester materials by means of dispersed dyestuffs in the presence of these carriers.

The known carriers used in textile practice for the dyeing of polyesters include halogenobenzenes, halogenotoluenes, N-alkylphthalimides, aromatic carboxylic esters, methylnaphthalene, diphenyl, diphenyl ethers, naphthol ethers, phenol ethers and hydroxydiphenyls. However, these compounds have disadvantages. All compounds, with the exception of N-alkylphthalimides, have a strong characteristic odour. Methylnaphthalene and the hydroxydiphenyls adversely affect the light fastness of the dyeing. Diphenyl ether has the disadvantage that its efficiency as a carrier strongly depends on the structure of the dispersed dyestuff used and therefore often nonreproducible dyes are obtained. N-alkylphthalimides exhibit a strong decrease in their efficiency as carriers at dyeing temperatures below 98° C., which restricts their use in the upper regions of open dyeing machines in which this temperature is not reached. Phthalic esters and benzoic esters have only limited efficiency as carriers and limited levelling properties and therefore require the use of large amounts.

The object of the present invention is to provide highly efficient halogen-free carriers which produce a level dyeing when used in small amounts. At the same time, the dyeing produced should meet high demands in terms of fastness properties and in the dyeing of mixed fibres no staining of the adjacent fibres should take place.

It has now been found that this object can be achieved by means of the carriers according to the invention which contain a mixture of N-alkylphthalimides (I) and compounds of the general formula

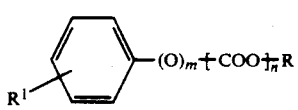

II in which

R is $C_1C_7$-alkyl; phenyl, benzyl or phenylethyl, which can be substituted by $C_1$–$C_4$-alkyl, $C_1$–$C_4$-alkoxy or $C_1$–$C_4$-alkoxycarbonyl, $R^1$ is hydrogen, $C_1$–$C_4$-alkyl, $C_1$–$C_3$-alkylcarbonyloxy, hydroxyl or $C_1$–$C_4$-alkoxycarbonyl, m is 0 or 1, n is 0 or m and n not being 0 at the same time.

These mixtures of active carrier substances exhibit a synergistic increase in the effect as dyeing accelerator, compared with the individual components.

The preferred weight ratio of N-alkylphthalimides (I) to the compounds (II) is 0.5–12:1.

Since the carrier mixtures according to the invention are water-insoluble, they are preferably added (to the dye liquors) in the form of preparations which contain emulsifiers and dispersants and, if desired, solvents.

Preference is given to carrier mixtures containing (1) 40–90, in particular 45–80, % by weight of (I), (2) 8–58, in particular 10–45, % by weight of (II), (3) 2–30, in particular 10–20, % by weight of an emulsifier and (4) 0–10% by weight of a solvent. The components (1)–(4) can also be used as mixtures.

N-alkylphthalimides (I) are understood to mean in particular phthalimides, or mixtures of them, substituted on the nitrogen by straight-chain or branched alkyl radicals ($C_1$–$C_6$), which can be prepared, for example, by reaction of phthalicanamines hydride or of phthalic esters with a means. The carriers can therefore contain phthalimides and phthalic esters as a result of their preparation.

Examples of compounds (II) are aromatic monocarboxylic esters (for example esters of benzoic acid, methylbenzoic acid, salicylic acid), dicarboxylic esters (for example esters of terephthalic acid or phthalic acid), carbonates (for example diphenyl carbonate) and ethers (for example diphenyl ether or ditolyl ether). The alcohol components of the esters can be, for example, $C_1C_6$-alkanols, phenols and benzyl alcohol.

Nonionic and anionic emulsifiers are preferred as emulsifiers (3).

Examples of suitable emulsifiers are mixtures of (a) ethoxylated oils, such as castor oil or soya bean oil, ethoxylated alcohols, alkylphenol polyglycol ethers or phenylalkylphenol polyglycol ethers, (b) alkali metal salts, alkaline earth metal salts and/or ammonium salts of organic sulfonic acids having at least 10 carbon atoms, such as dodecylbenzenesulfonic acid, diisobutylnaphthalenesulfonic acid, alpha-sulfo fatty acids and N-methylricinoleotauride.

Examples of suitable solvents (4), which may improve the viscosity of the formulation, are alkanols, glycols, ketones, N-substituted caprolactams or ethers.

Particularly preferred carriers contain (1) 50–75% by weight of an N-alkylphthalimide which has a straight-chain or branched alkyl radical of 3–5 C atoms, (2) 10–40% by weight of a $C_1$–$C_4$-alkyl, phenyl or benzyl ester of benzoic, methylbenzoic, terephthalic, phthalic or salicylic acid or diphenyl carbonate, diphenyl ether or ditolyl ether and (3) 5–20% by weight of an addition product of 15–30 mol of ethylene oxide with castor oil or soya bean oil, or 5–50 mol of ethylene oxide and/or propylene oxide with $C_{16}$–$C_{22}$-fatty alcohols, octyl- or nonylphenol or phenylethylphenol, alkali metal salts, alkaline earth metal salts, ammonium salts or mono-, di- or triethanolamine salts of dodecylbenzenesulfonic acid.

Since the carrier mixtures according to the invention are very compatible with other carriers, they can also be used in a mixture with other known carriers.

The dispersed dyestuffs which are used for the dyeing are the dispersed dyestuffs customarily used for the dyeing of polyesters, such as described, for example, in "Colour Index" Vol. 2, p. 2483–2741, 3rd Edition, (1971). The dyeing in the presence of the carriers according to the invention is carried out by the batchwise processes customary for the dyeing by means of dispersed dyestuffs; these include the customary process operating at 98° C. and the high-temperature process.

The carrier mixtures according to the invention are also suitable for the dyeing of polyester/wool and polyester/cotton mixed fabrics, because, if they are used, the staining of the wool and cotton portions by the dispersed dyestuffs is avoided.

The use of the carrier mixtures makes it possible to dye structures, for example threads, fibres, woven fabrics, mixed fabrics, films and sheets made of polyesters such as glycol polyterephthalate, or polyester mixed fabric by means of dispersed dyestuffs in deep shades and highly uniformly. The dyeing can be carried out at temperatures of 90–140° C., the preferred use in industry taking place at 90–105° C.. An additional advantage of the carrier formulations described is the very good efficiency below the boiling temperature, which is not shown by pure N-alkylphthalimide carriers, for example at 95° C., which is often not exceeded under practical conditions in the case of open dyeing temperatures (sic).

The amount of the mixture of carriers (I) and (II) required for carrying out the dyeing can be easily determined from case to case by preliminary tests. In general, amounts of 1 to 7 g per liter of dye liquor at conventional liquor ratios of 5:1 to 40:1 has proven to be suitable.

The use of components (I) and (II) as carriers in the dyeing of polyesters is known.

Thus, for example, the use of N-alkylphthalimides is described in German Patent Specification 1,769,210, the use of phthalic esters in U.S. Patent Specification No. 4,032,291 and the use of benzoic esters in German Auslegeschrift No. 2,348,363. German Patent Specification No. 1,769,210 also discloses the use of mixtures of N-alkylphthalimides with disubstituted benzoic esters.

Surprisingly, it has now been found that the mixtures according to the invention have a higher efficiency as dyeing accelerators than corresponds to the sum of the individual efficiencies. This synergistic increase in the efficiencies is not exhibited by the previously known mixtures (for example the mixtures of N-alkylphthalimides with alkyl-containing salicylic acid compounds described in German Patent Specification No. 1,769,210). The mixing ratio at which the synergistic effect is at an optimum is dependent on the components of the carrier mixtures and can be easily determined in the individual case by preliminary tests.

EXAMPLE 1

Yarns made of polyester fibres are introduced at a liquor ratio of 40:1 in to a bath heated to 60° C. which contains per liter, 0.25 g of a dye of the formula

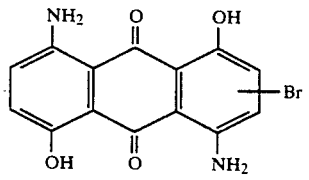

2 g of a condensation product of naphthalenesulfonate and formaldehyde, 2 g of sodium dihydrogen phosphate and 3 g of a carrier formulation of the following composition:

1.80 g of N-alkylphthalimides (alkyl=50% of n-butyl, 50% of n-propyl)
0.75 g of methyl 4-methylbenzoate
0.25 g of tri(methylphenylethyl)phenol with about 15 mol of EO
0.20 g of the monoethanolamine salt of dodecylbenzenesulfonic acid The pH of the bath is adjusted to 4.5–5 with acetic acid. The bath is then heated to 98° C. and maintained at this temperature for 60 minutes. This gives a uniform blue dyeing.

EXAMPLES 2–12

The dyeing is carried out as described in Example 1, using carrier formulations of the following compositions:

Example 2

1.65 g of N-butylphthalimide
0.90 g of ethyl 4-methylbenzoate
0.20 g of calcium dodecylbenzenesulfonate (70% in butanol)
0.20 g of castor oil with about 30 mol of EO
0.05 g of stearyl hexaethylene glycol ether

Example 3

2.25 g of N-butylphthalimide
0.30 g of dimethyl terephthalate ester
0.25 g of tri(methylphenylethyl)phenol with about 15 mol of EO
0.20 g of the monoethanolamine salt of dodecylbenzenesulfonic acid

Example 4, 1.50 g of N-butylphthalimide
1.05 g of methyl salicylate ester
0.25 g of tri(methylphenylethyl)phenol with about 15 mol of EO
0.20 g of the monoethanolamine salt of dodecylbenzenesulfonic acid

Example 5

1.50 g of N-alkylphthalimides (alkyl=50% of n-butyl, 30% of propyl, 20% of ethyl)
1.05 g of benzyl benzoate ester
0.25 g of di(phenylethyl)phenol with about 10 mol of EO
0.20 g of the monoethanolamine salt of dodecylbenzenesulfonic acid

Example 6

1.80 g of N-alkylphthalimides (alkyl=70% of butyl, 30% of propyl)
0.75 g of n-butyl benzoate
0.30 g of castor oil with about 30 mol of EO
0.15 g of calcium dodecylbenzenesulfonate (70% in butanol)

Example 7

2.10 g of N-butylphthalimide
0.45 g of phenyl benzoate
0.30 g of di(methylphenylethyl)phenol with about 12 mol of EO
0.15 g of calcium dodecylbenzene sulfonate (70% in butanol)

Example 8

1.50 g of N-butylphthalimide
0.30 g of di(phenylethyl)phenol with about 10 mol of EO
0.15 g of the monoethanolamine salt of dodecylbenzenesulfonic acid

10 Example 9

1.90 g of N-alkylphthalimide (alkyl=50% of butyl, 30% of propyl, 20% of ethyl)
0.65 g of diphenyl carbonate
0.25 g of tri(methylphenylethyl}phenol with about 15 mol of EO 0.20 g of the monoethanolamine salt of dodecylbenzenesulfonic acid Example 10

2.10 g of N-butylphthalimide
0.45 g of butyl 2-methylbenzoate
0.25 g of tri(methylphenylethyl)phenol with about 15 mol of EO
0.20 g of the monoethanolamine salt of dodecylbenzenesulfonic acid Example 11

1.50 g of N-alkylphthalimid (alkyl=60% of n-butyl, 40% of n-propyl)
1.05 g of ethyl 3-methylbenzoate
0.25 g of tri(methylphenylethyl)phenol with about 15 mol of EO
0.20 g of the monoethanolamine salt of dodecylbenzenesulfonic acid 5 Example 12

1.50 g of N-butylphthalimide
1.05 g of ditolyl ether
0.25 g of tri(methylphenylethyl)phenol with about 15 mol of EO
0.20 g of the monoethanolamine salt of dodecylbenzenesulfonic acid In each case, a uniform blue dyeing is obtained. The efficiency as carrier of the carrier mixtures of Examples 1–12 is determined by comparison with the colour depth obtained. The table below lists the amount of carrier mixture and that of ester/ether (II) required for obtaining the same colour depth. The amount listed is based on the amount of N-alkylphthalimide (I)=100. The small amount of the mixtures show that they have a more advantageous efficiency as carriers, compared with the individual components.

| Example | % by weight of the compounds in the mixture | Necessary amount of | |
|---|---|---|---|
| | | Mixture | Components II |
| 1 | 60 I<br>25 II | 80 | 100 |
| 2 | 55 I<br>30 II | 80 | 90 |
| 3 | 75 I<br>10 II | 80 | 120 |
| 4 | 50 I<br>35 II | 80 | 125 |
| 5 | 50 I<br>35 II | 60 | 80 |
| 6 | 60 I<br>25 II | 80 | 120 |
| 7 | 70 I<br>15 II | 80 | 90 |
| 8 | 50 I<br>35 II | 80 | 100 |
| 9 | 63 I<br>22 II | 60 | 80 |
| 10 | 70 I<br>15 II | 90 | 120 |
| 11 | 50 I<br>35 II | 80 | 100 |
| 12 | 60 I<br>25 II | 90 | 120 |

EXAMPLE 13

(comparative example with respect to German Patent Specification No. 1,769,210)

Example 1

Yarns made of polyester fibres are introduced at a liquor ratio of 40:1 into a bath heated to 60° C. which contains per liter 0.25 g of a dye of the formula

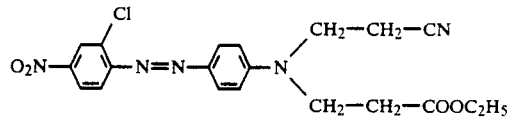

2 g of a condensation product of naphthalenesulfonate and formaldehyde, 2 g of sodium dihydrogen phosphate and 3 g of a carrier formulation of the following composition:

1.80 g of N-alkylphthalimides (alkyl=60% of butyl, 40% of propyl)
0.75 g of ethyl o-cresotinate
0.25 g of tri(methylphenylethyl)phenol with about 15 mol of EO
0.20 g of the monoethanolamine salt of dodecylbenzenesulfonic acid The pH of the bath is adjusted to 4.5–5 with acetic acid. The bath is then heated to 98° C. and maintained at this temperature for 60 minutes. This gives a uniform blue dyeing. The efficiency as carrier is determined as described above ((I)=100).

| % by weight of the component in the mixture | Necessary amount of | |
|---|---|---|
| | mixture | ester |
| 60 of I<br>25 of the ester according to German Patent Specification 1,769 210 | 100 | 100 |

In contrast to the carrier mixtures claimed, this mixture shows no synergistic increase of the efficiency as carrier, compared to the individual components.

EXAMPLE 14

Pieced goods consisting in weft and warp of polyester spin fibres are introduced at a liquor ratio of 40:1 into a bath heated to 50° C. which contains per liter 0.25 g of a dye of the formula

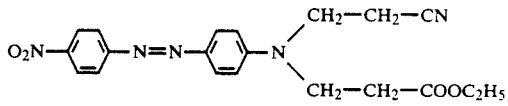

2 g of a condensation product of naphthalenesulfonate and formaldehyde, 2 g of sodium dihydrogen phosphate and 2.5 g of a carrier formulation of the following composition:

1.80 g of N-alkylphthalimides (alkyl=60% of butyl, 40% of propyl)
0.75 g of methyl 4-methylbenzoate
0.25 g of tri(methylphenylethyl)phenol with about 15 mol of EO
0.20 g of the monoethanolamine salt of dodecylbenzenesulfonic acid The pH of the bath is adjusted to 4.5–5 with acetic acid. The dye liquor is then brought to boiling temperature and maintained at this temperature for 1 hour. A full uniform red dyeing is obtained.

EXAMPLE 15

Polyester spin fibres are introduced at a liquor ratio of 15:1 into a dye liquor containing per liter 1 g of a disperse dyestuff according to Example 14, 0.03 g of a dye according to Colour Index, 2nd Edition (1956) Volume 3, No. 12790, 2 g of a condensation product of naphthalenesulfonate and formaldehyde, 2 g of sodium dihydrogen phosphate and 3.5 g of a carrier formulation from Example 14. The pH of the bath is adjusted to 4.5–5 with acetic acid. The liquor is slowly heated to 98° C. and the material is treated at this temperature for 1 hour. A dark red-brown dyeing is obtained.

We claim:

1. Carrier mixture containing N-alkylphthalimides (1) and compounds of the general formula

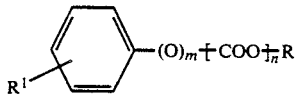

II in which

R is $C_1$–$C_7$-alkyl; phenyl, benzyl or phenylethyl, which can be substituted by $C_1$–$C_4$-alkyl, $C_1$–$C_4$-alkoxy or $C_1$–$C_4$-alkoxycarbonyl, $R^1$ is hydrogen, $C_1$–$C_4$-alkyl, $C_1$–$C_4$-alkylcarbonyloxy, hydroxyl or $C_1$-$C_4$-alkoxycarbonyl, m is 0 or 1, n is 0 or 1, m and n not being 0 at the same time the carrier mixture containing components (I) and (II) in a weight ratio of 0.5–12:1.

2. Carrier mixture according to claim 1, containing (1) 40–90% by weight of (I), (2) 8–58% by weight of (II), (3) 2–30% by weight of emulsifier and (4) 0–10% by weight of a solvent.

3. Carrier mixture according to claim 1, containing (1) 50–75% by weight of an N-alkylphthalimide which has a straight-chain or branched alkyl radical of 3–5 C atoms, (2) 10–40% by weight of a $C_1$–$C_4$-alkyl phenyl or benzyl ester of benzoic, methylbenzoic, terephthalic, phthalic or salicylic acid or diphenyl carbonate, diphenyl ether or ditolyl ether and (3) 5–20% by weight of an addition product of 15–30 mol of ethylene oxide with castor oil or soya bean oil, of 5–50 mol of ethylene oxide and/or propylene oxide with $C_{16}$–$C_{22}$-fatty alcohols, octylphenol or nonylphenol or phenylethylphenol, alkali metal salts, alkaline earth metal salts, ammonium salts or (di)ethanolamine salts of dodecylbenzenesulfonic acid.

4. Process for the dyeing of polyester materials with disperse dyestuffs in the presence of carrier mixtures of claim 1.

* * * * *